United States Patent [19]

Horie et al.

[11] Patent Number: 4,984,326

[45] Date of Patent: Jan. 15, 1991

[54] BLADE FOR ELECTROPHOTOGRAPHIC APPARATUS

[75] Inventors: Shinji Horie; Hideto Shimizu; Michio Ohmori; Hiroshi Yui, all of Mie, Japan

[73] Assignees: Mitsubishi Petrochemical Co., Ltd.; Ricoh Company Ltd., both of Tokyo, Japan

[21] Appl. No.: 360,890

[22] PCT Filed: Sep. 16, 1988

[86] PCT No.: PCT/JP88/00946

§ 371 Date: May 24, 1989

§ 102(e) Date: May 24, 1989

[87] PCT Pub. No.: WO89/05000

PCT Pub. Date: Jun. 1, 1989

[30] Foreign Application Priority Data

Nov. 27, 1987 [JP] Japan ..... 62-299034

[51] Int. Cl.[5] ..... G03G 21/00

[52] U.S. Cl. ..... 15/256.5; 15/1.5; 355/299

[58] Field of Search ..... 15/256.5, 256.51, 1.5; 355/299; 430/125; 118/652

[56] References Cited

FOREIGN PATENT DOCUMENTS

| | | | |
|---|---|---|---|
| 59-68770 | 4/1984 | Japan . | |
| 60-243688 | 12/1985 | Japan . | |
| 61-48881 | 3/1986 | Japan . | |
| 61-48882 | 3/1986 | Japan . | |
| 0144684 | 7/1986 | Japan | 355/299 |
| 61-255375 | 11/1986 | Japan . | |

*Primary Examiner*—Edward L. Roberts

*Attorney, Agent, or Firm*—Oblon, Spivak, McClelland, Maier & Neustadt

[57] ABSTRACT

AS blade of an electrophotographic apparatus using a toner which can be integrally molded with a metallic holder and has high dimensional precision, stable charging charactersitics, and excellent properties of preventing adhesion of a toner, said blade being characterized by comprising a fluorocarbon polymer composition comprising 60 to 95% by weight of a fluorocarbon polymer, 40 to 5% by weight of a positively chargeable and non-conductive inorganic filler having an average particle diameter of 5 μm or less, and 0 to 25 parts by weight, per 100 parts by weight of the total of said fluorocarbon polymer and inorganic filler, of a conductive filler having an average particle diameter of 5 μm or less.

11 Claims, 8 Drawing Sheets

BLADE FOR ELECTROPHOTOGRAPHIC APPARATUS

FIELD OF THE INVENTION

This invention relates to a blade of electrophotographic apparatus using a toner, and more particularly, a blade of an electrophotographic apparatus which is used for controlling frictional charge of a toner, controlling the amount of the toner which is supplied to a photoreceptor in a thin film, cleaning the photoreceptor through scraping, and the like.

BACKGROUND OF THE TECHNIQUE

Conventional blades of electrophotographic apparatus (hereinafter simply referred to as blades) have been made of resin materials to which a metallic plate is adhered for carrying out static charge control of a toner, thinning of a toner layer electrostatically adsorbed to a toner-feeding roller, and removal of the toner remaining on a photoreceptor after toner transfer by scraping to clean the photoreceptor in the development zone of a dry process electrostatic copying machine.

The resin materials which have been generally used in such blades for electrophotographic apparatus (hereinafter simply referred to as blades) include urethane rubbers and silicone rubbers.

The blade is generally composed of resin blade 22 of a plate shape which is adhered to metallic holder 21 of a plate shape on surface of adhesion 23 as shown in FIG. 20. The conventional blade of this type has been manufactured by adhering resin plate 22 to metallic holder 21 and post-finishing the portion of the resin plate 22 to be in contact with a development roller or a photoreceptor by cutting or polishing.

The materials to be used for the blades of electrophotographic apparatus are required to have properties of repelling an object in contact, such as a toner, or allowing no penetration of such an object, as well as charging characteristics. It is also demanded that they can be manufactured through processes requiring no post-finishing, etc.

However, urethane rubbers which have been used in the conventional blades of electrophotographic apparatus have problems in charging characteristics and toner adhesion. Silicone rubbers also have problems in charging characteristics. Compounding of a charge depressant as disclosed in JP-A-No. 61-173270 sometimes brings about slight improvements, but compounding of a charge depressant gives rise to another problem that the blade itself becomes brittle. In addition, since the silicone rubbers are heat-curable resin having a cross-linking structure, they essentially require post-finishing.

Post-finishing including cutting is carried out for obtaining dimensional precision of the tip of the blade. Because the dimensional precision of the blade tip has influences on the state of a thin toner layer and the like, namely great influences on image quality, the post-finishing for obtaining a blade of desired dimensional precision entails much labor with inefficiency and bad economy.

DISCLOSURE OF THE INVENTION

The inventors have extensively studied the above-described problems and, as a result, settled all these problems at once by using a composition comprising a specific resin admixed with a specific fine powder as a material of blades. The present invention provides a blade of extremely high performance and high dimensional precision which can be obtained through a simple and easy molding method.

That is, the present invention relates to a blade of an electrophotographic apparatus using a toner which is characterized by comprising a fluorocarbon polymer composition which comprises 60 to 95% by weight of a fluorocarbon polymer, 40 to 5% by weight of a positively chargeable and non-conductive inorganic filler having an average particle diameter of 5 μm or less, and 0 to 25 parts by weight, per 100 parts by weight of the total of the fluorocarbon polymer and the non-conductive inorganic filler, of a conductive filler having an average particle diameter of 5 μm or less.

Fluorocarbon Polymer

The fluorocarbon polymer to be used in a blade of an electrophotographic apparatus according to the present invention can appropriately be selected from commercially available fluorocarbon polymers, such as polyvinyl fluoride, polyvinylidene fluoride, polychlorotrifluoroethylene, ethylene-tetrafluoroethylene copolymers, ethylene-chlorotrifluoroethylene copolymers, tetrafluoroethylene-hexafluoropropylene copolymers, tetrafluoroethylene-propylene copolymers, tetrafluoroethylene-perfluoroalkylvinyl ether copolymers, vinylidene fluoride-hexafluoropropylene copolymers, vinylidene fluoride-hexafluoropropylene-tetrafluoroethylene copolymers, etc. From the standpoint of heat resistance and charging properties, those containing a large quantity of fluorine atom, such as tetrafluoroethylene and hexafluoropropylene, e.g., vinylidene fluoridehexafluoropropylene copolymers, ethylene-tetrafluoro ethylene copolymers, and tetrafluoroethylene-perfluoroalkylvinyl ether copolymers, are preferably used. Further, thermoplastic polymers are preferred in view of ease in molding.

These fluorocarbon polymers may be used in combinations of two or more thereof for the purpose of controlling physical properties, such as flexibility.

Non-Conductive Inorganic Filler

The non-conductive inorganic filler which can be used in this invention includes those having an average particle diameter of 5 μm of less, preferably 3 μm or less, from the standpoint of uniform miscibility, appearance of molded articles, and impenetrability to liquids. Those having an average particle size of more than 5 μm are not favorable because they cause unevenness of the surface of molded articles.

The aforesaid inorganic filler should be positively chargeable. The term "positively chargeable inorganic filler" as used herein means inorganic fillers other than those showing minus values or zero microcoulomb/gram (μC/g) as measured by a blow-off method, a method for determining charge quantity of powders (cf. Oguchi, et al., *Denshishashin*, Vol. 16, p. 52 (1977)) Of these positively chargeable inorganic fillers, those having a positive chargeability of 5 μC/g or more are preferred.

The inorganic fillers having exhibiting such positive chargeability include, for example, magnesium oxide, zinc oxide, lead oxide, aluminum oxide, iron oxide, cobalt oxide, mica, asbestos, talc, calcium carbonate, calcium phosphate, barium sulfate and ceramics, e.g., barium titanate, lead titanate, silicon nitride and silicon carbide. In particular, zinc oxide and magnesium oxide are preferred. These inorganic fillers should be stable to fluorine-containing resins because they come to contact with the fluorocarbon polymer in high temperatures during molding processing.

These inorganic fillers may be used in combinations of two or more thereof for the purpose of controlling charging properties or molding processability.

Conductive Filler

The conductive filler which can be used in this invention may be any of carbon-based fillers, e.g., carbon black, carbon fiber, graphite, etc., metallic fillers, e.g., metallic fine powders, metallic flakes, metallic fibers, etc., and non-conductive or conductive fillers whose surface is coated with a conductive substance, e.g., metals, as long as it has an average particle diameter of 5 μm or less.

Specific examples of the conductive fillers are acetylene black, oil furnace black, thermal black, channel black, pitch type carbon fibers, PAN type carbon fibers, natural graphite, artificial graphite, copper powders, silver powders, nickel powders, iron powders, aluminum powders, amorphous iron powders, aluminum flakes, aluminum fibers, nickel fibers, stainless steel fibers, metal coated glass beads, metal-plated carbon black, and so on. The shape of the conductive filler is not limited and may be a granular form, a tabular form, or a fibrous form. Those having an average particle size exceeding 5 μm are likely to cause unevenness of the surface of molded articles which may result in reduction of charge imparting properties and, therefore, are unfavorable. The average particle size is preferably 3 μm or less, and particularly 1 μm or less, from the standpoint of uniform miscibility, appearance of molded articles, charge imparting properties, and impenetrability to liquids.

Preferred of them are carbon-based fillers, with carbon black being more preferred. In particular, those having a specific surface area of 900 $m^2/g$ or more as measured from an $N_2$ absorption amount according to the BET method are preferred because of their capability of endowing the composition with necessary conductivity at a low compounding ratio.

As preferable kinds of carbon-based fillers, acetylene black and furnace black are preferred because of their low impurity contents and excellent conductivity. Among them particularly preferred are XCF (extra conductive furnace black), SCF (super conductive furnace black), CF (conductive furnace black) and SAF (super abrasion furnace black) of furnace black Examples of XCF are "Ketjenblack EC" made by Nippon E.C., "Vulcan XC-72" made by Cabot G. L. Inc. Examples of SCF are "Vulcan SC" and "Vulcan P" made by Cabot G. L. Inc., and "Corax L" made of Degussa Co. Examples of CF are "Vulcan C" made by Cabot G. L. Inc. and "Conductex SC" made by Columbian Co. Examples of SAF are "Asahi #90" made by Asahi Carbon Co., "Diablack A" made of Mitsubishi Chemical Ind., Ltd., and "Vulcan 9" made by Cabot G. L. Inc.

Since these conductive fillers come to contact with the fluorocarbon polymer in high temperatures, they should be stable to fluorine-containing resins. For example, the water content of the conductive filler is preferably not more than 0.5% by weight, more preferably not more than 0.2% by weight. With the average particle diameter and water content being suitable, different kinds of these conductive fillers, such as carbon black and graphite or carbon fiber, may be used in combination.

Fluorocarbon Polymer Composition

The above-described fluorocarbon polymer and nonconductive inorganic filler and, if desired, conductive filler are mixed in a specific compounding ratio to prepare a fluorocarbon polymer composition. The composition comprises 60 to 95% by weight, preferably 65 to 92% by weight, of the polymer, 40 to 5% by weight, preferably 35 to 8% by weight, of the nonconductive inorganic filler, and 0 to 25 parts by weight, preferably 2 to 20 parts by weight, per 100 parts by weight of the total of the polymer and nonconductive inorganic filler, of a conductive filler. If the amount of the non-conductive inorganic filler is less than 5% by weight, that is, if the amount of the polymer exceeds 95% by weight, there can be enjoyed no effects on charging characteristics. On the other hand, if it exceeds 40% by weight, that is, if the polymer is less than 60% by weight, the non-conductive filler finds difficulty in uniformly dispersing in the fluorocarbon polymer, causing, for example, deterioration of appearance of molded articles. Addition of the conductive filler within the above-stated range further enhances the effects of the present invention. However, if its amounts exceeds the above-recited range, the electric characteristics of the resulting blade deviate from the ranges required for blades.

The fluorocarbon polymer composition of the present invention can contain other additive components as long as they do not seriously affect the effects of the present invention. In particular, in order to further improve charging characteristics of the fluorocarbon polymer composition, compatibility of the polymer with inorganic fillers, and molding processability (fluidity), and the like, it is possible to add not more than 5% by weight, preferably from 0.01 to 3% by weight, of heat-resistant oligomers, such as positively chargeable silicone oils or negatively chargeable fluorocarbon oligomers.

The fluorocarbon polymer composition to be used in a blade of an electrophotographic apparatus can be prepared by means of commonly employed mixing or kneading machines or methods, such as rolls Brabender Plastgraphs, extruders, and so on.

In the preparation of the composition, it is necessary to sufficiently control a water content of each component. A recommended water content of each component is 0.5% by weight or less, preferably 0.2% by weight or less, more preferably 500 ppm or less. If it exceeds the above-recited range, adverse effects may be sometimes exerted upon charging characteristics. Cares should also be taken about the water content during preservation of the composition after preparation. The water content of the composition during preservation is preferably controlled to 0.5% by weight or less. For water content control, force-drying by hot-air drying or vacuum drying is sometimes required.

The blades of electrophotographic apparatus according to the present invention are generally used as a composite with a metallic holder. The metallic holder to be combined is produced from a metal selected from those widely employed in the art, such as aluminium, iron, stainless steel, copper, and brass, from the viewpoint of precision, strength, cost, and the like. Aluminum, stainless steel, or plated iron is usually employed.

It is preferable that the metallic holder and the resin blade are integrally molded, but they may be used as merely adhered to each other. Integrally molded articles can be obtained by covering a projection of a metallic holder with a molten resin or filling a recess of a metallic holder with a molten resin, followed by cooling, so that the molded articles may have such a structure in which the metallic holder and the resin blade may be engaging with each other. By virtue of this structure, the resin blade can be prevented from releasing from the metallic holder, and a high level of precision of the blade can be maintained.

Hence, in the case of integral molding, the molding method is not restricted as long as the resulting blade has a structure in which the resin blade and the metallic holder are engaging with each other.

The structure in which the resin blade and the metallic holder are engaging includes the following embodiments.

(1) A blade for electrophotographic apparatus composed of a resin blade and a metallic holder supporting the resin blade, which is characterized in that the metallic holder has a projection whose tip is larger than the root thereof, and the resin blade is integrally molded so as to include said projection.

(2) A blade for electrophotographic apparatus composed of a resin blade and a metallic holder supporting the resin blade, which is characterized in that the metallic holder has a recess whose bottom is larger than the opening thereof, and the resin blade is integrally molded with said metallic holder, said recess being filled with a part of said resin blade thereby supporting the resin blade.

(3) A blade for electrophotographic apparatus composed of a resin blade and a metallic holder supporting the resin blade, which is characterized in that the metallic holder has perforations in the direction different from the direction of release of the resin blade, and the resin blade is integrally molded with said metallic holder, said perforations being filled with a part of said resin blade thereby supporting the resin blade.

(4) A blade for electrophotographic apparatus composed of a resin blade and a metallic holder supporting the resin blade, which is characterized in that the resin blade is integrally molded with the metallic holder in such a manner that said metallic holder is included within said resin blade.

The processes for producing these integrally molded articles not only are simpler than those for adhered articles but, when performed by use of a precise mold, do not require finishing after molding and provide high processing precision. In addition, since the integrally molded articles have a structure in which the resin blade portion is hardly released from the metallic holder, the necessity of exchanging parts in case of release during use can be eliminated, thus offering an advantage from the standpoint of after-care of products using the blade as a part. The above-described structure (4) in which the resin blade material is molded so as to include the metallic holder is particularly preferred because the shape of the metallic holder is of little consideration. Methods for the integral molding include extrusion molding, injection molding (insert molding), compression molding, and transfer molding. Injection molding is particularly preferred in view of economy and dimensional precision.

BRIEF EXPLANATION OF THE DRAWINGS

FIGS. 1 to 7 depict the type of a blade obtained by integral molding by use of a metallic holder having a projection whose tip is larger than the root thereof. FIGS. 8 to 11 depict the type of a blade obtained by integral molding by use of a metallic holder having a recess whose bottom is larger than the opening thereof. FIGS. 12 to 18 depict the type of a blade obtained by integral molding by use of a metallic holder having perforations. FIG. 19 depicts the type of a blade obtained by integrally molding a resin blade material so as to include a metallic holder. FIG. 20 depicts the type of a blade obtained by adhering a metallic holder and a resin blade. 1 . . . Blade of Electrophotographic apparatus 2 . . . Metallic holder 2a . . . Projection 2b . . . Recess 3 . . . Resin composition 5 . . . Perforation 6 . . . Fixing portion 7 . . . Direction of release of blade 8 . . . Direction perpendicular to 7 9 . . . Recess 21 . . . Metallic holder of a plate shape 22 . . . Resin blade of a plate shape 23 . . . Surface of adhesion

PREFERRED EMBODIMENTS FOR CARRYING OUT THE INVENTION

EXAMPLES 1 TO 2 AND COMPARATIVE EXAMPLES 1 TO 2

Prior to carrying out the following embodiment, the resin component was adjusted to have a bound water content of 500 ppm or less by hot-air drying, and the non-conductive inorganic filler component was adjusted to have a water content of 500 ppm or less by vacuum drying at 120° C.

A resin component comprising 83.3% by weight of vinylidene fluoride polymer pellets ("Kynar 720", produced by Pennwalt, Co.), 11.1% by weight of cold-ground vinylidene fluoride polymer of the same kind, and 5.6% by weight of a fluorine-containing rubber ("Viton B-50, produced by E. I. Du Pont de Nemours & Co., Inc.) and a positively chargeable non-conductive inorganic filler component comprising 20% by weight of magnesium oxide (average particle diameter: 1 μm) and 80% by weight of zinc oxide (average particle diameter 0.5 μm) were dry blended at a ratio shown in Table 1. The resulting dry blend was kneaded in a vented twin-screw extruder having a diameter of 30 mm at 245° C. to prepare pellets of a resin composition.

Figure 1:
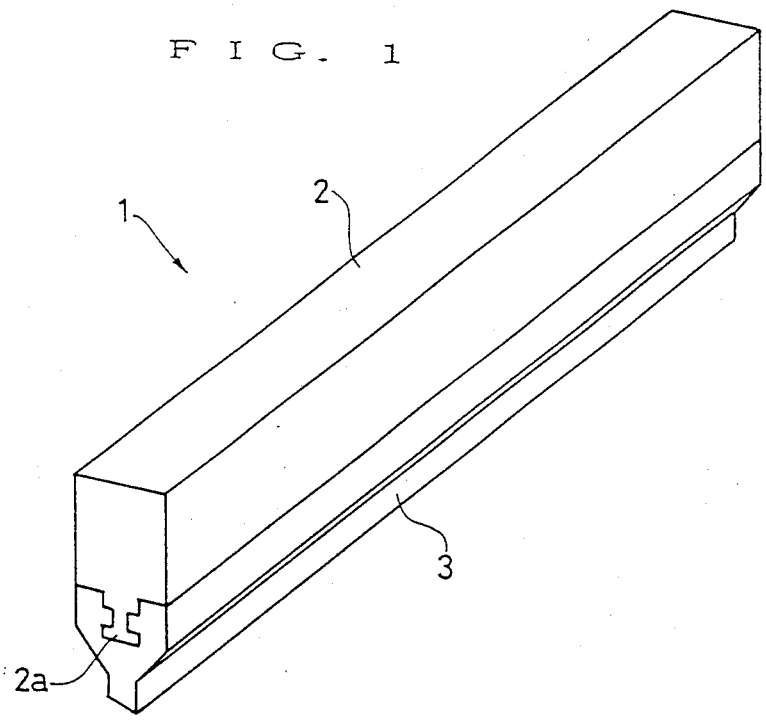
FIGS. 1, 8, 12, 19, and 20 each illustrates a perspective view or a perspective sectional view of a blade of electrophotographic apparatus according to the present invention.
Figure 2:
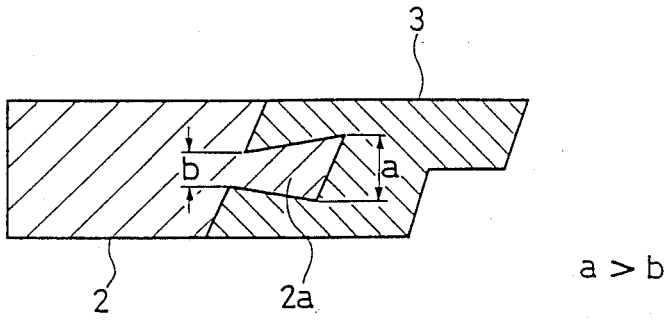
FIGS. 2 to 5 and 9 each illustrates a cross-sectional view of a blade of electrophotographic apparatus according to the present invention.
Figure 3:
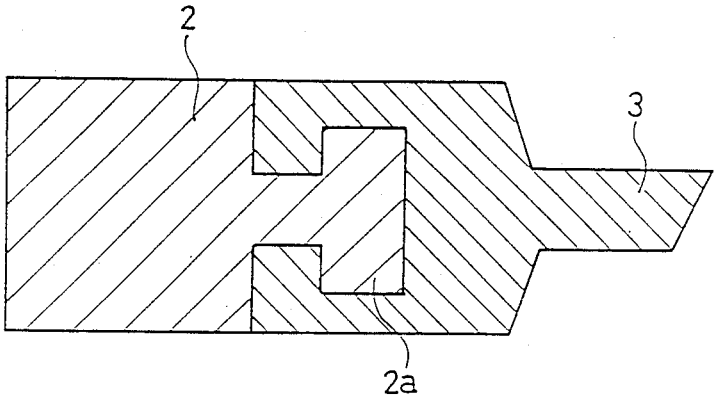
Figure 4:
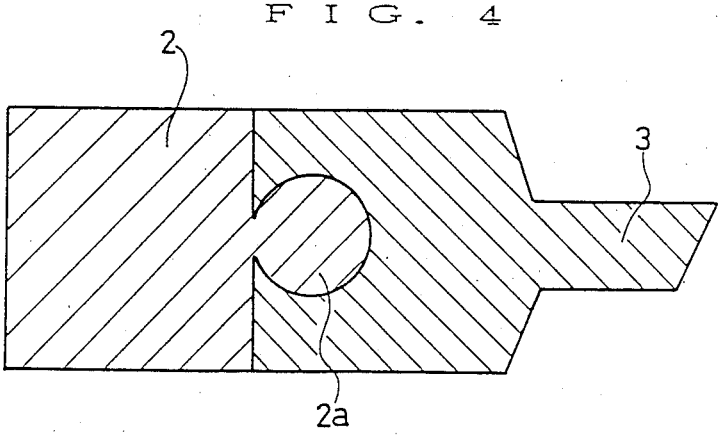
Figure 5:
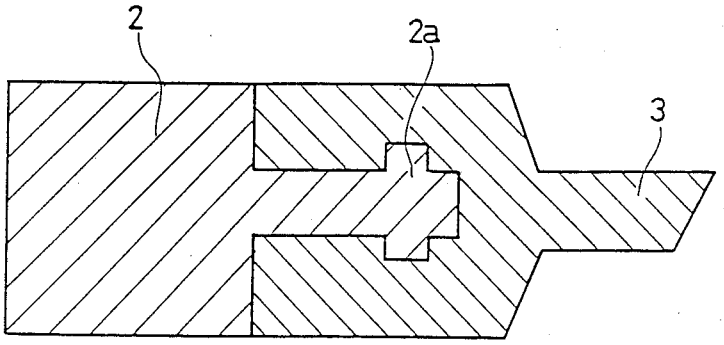
Figure 6:
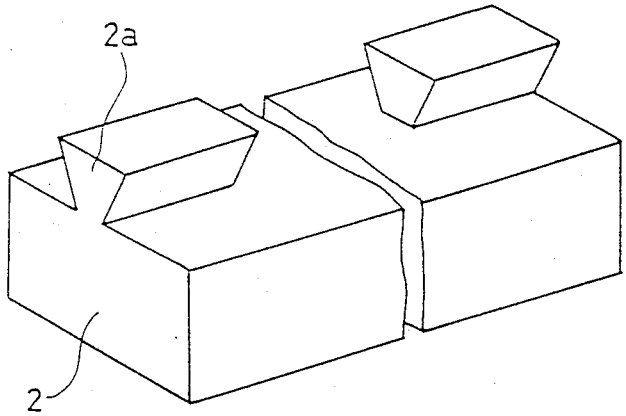
FIGS. 6, 7, 10, 11, and 13 to 18 each illustrates a perspective sectional view of a metallic holder.
Figure 7:
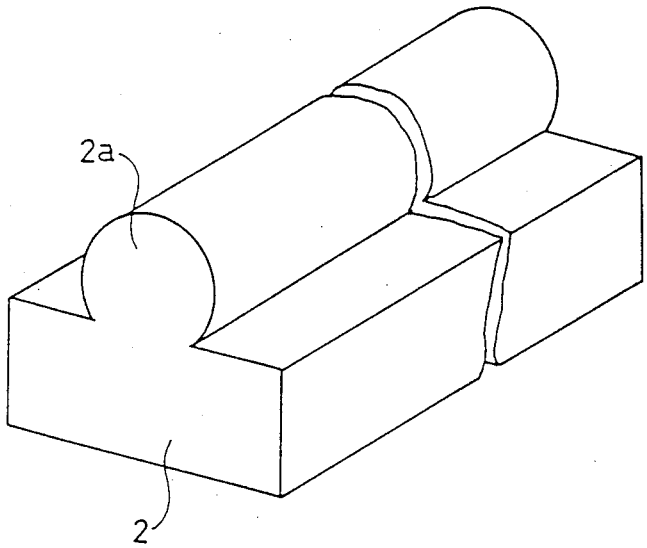
Figure 8:
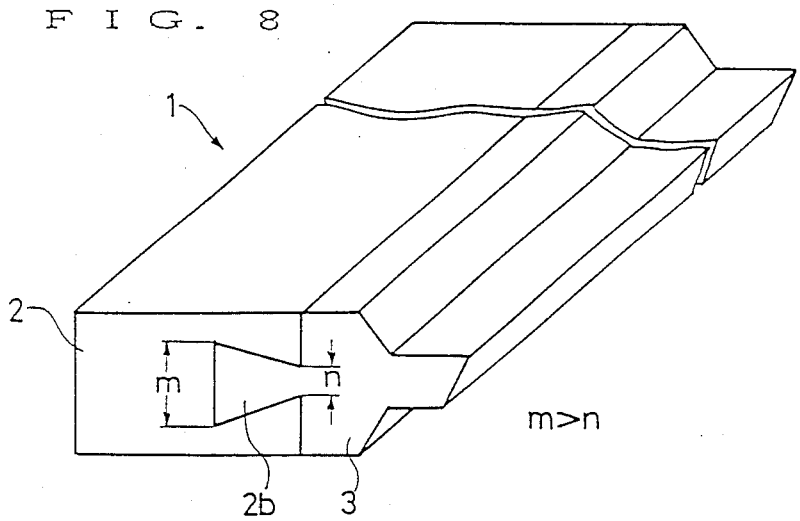
Figure 9:
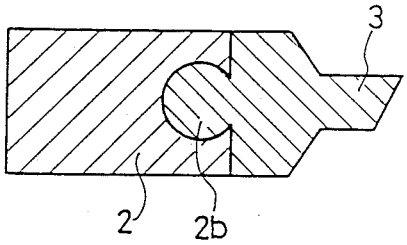
Figure 10:
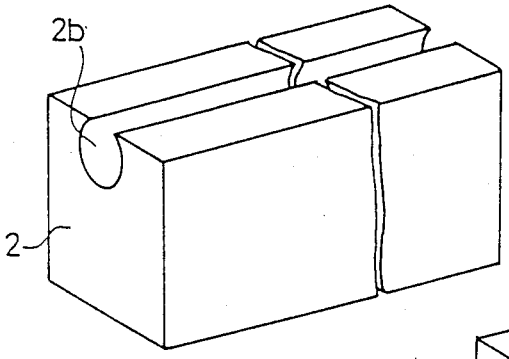
Figure 11:
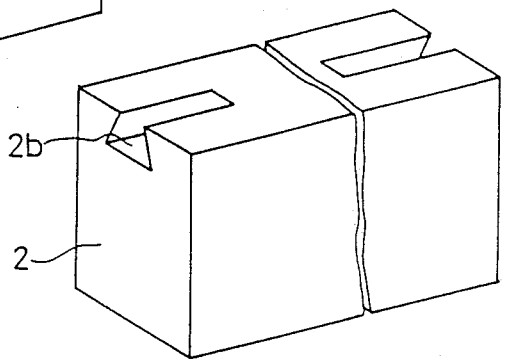
Figure 12:
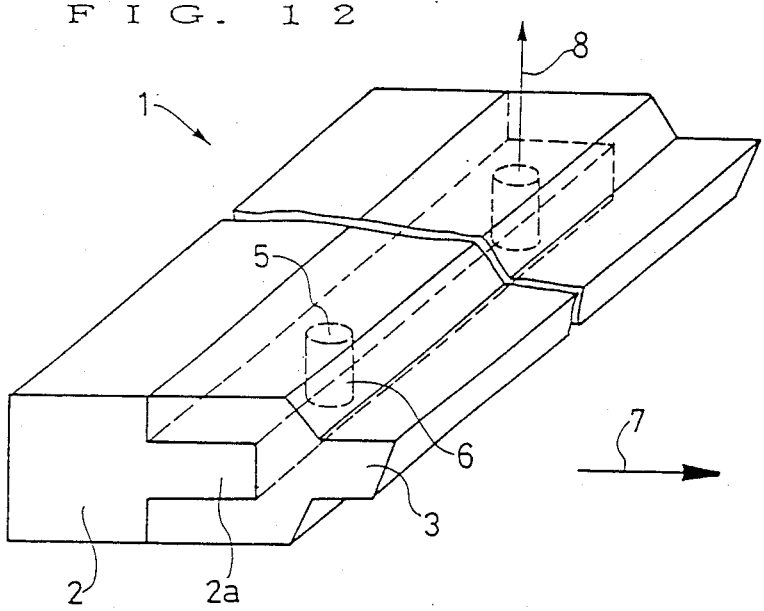
Figure 13:
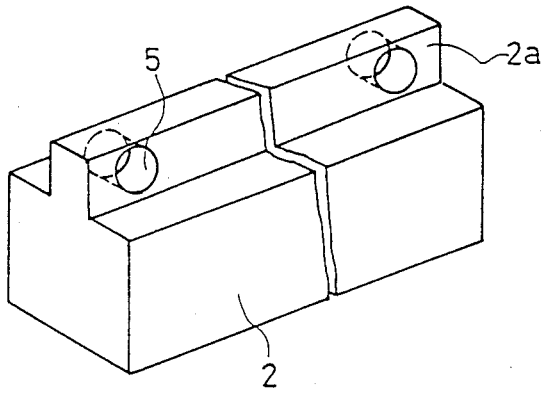
Figure 14:
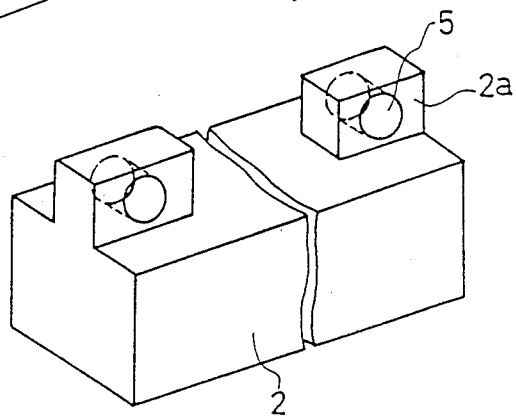
Figure 15:
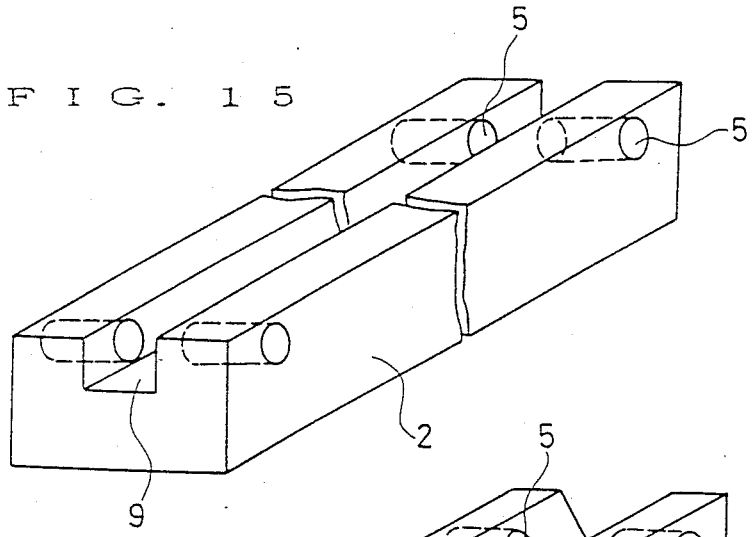
Figure 16:
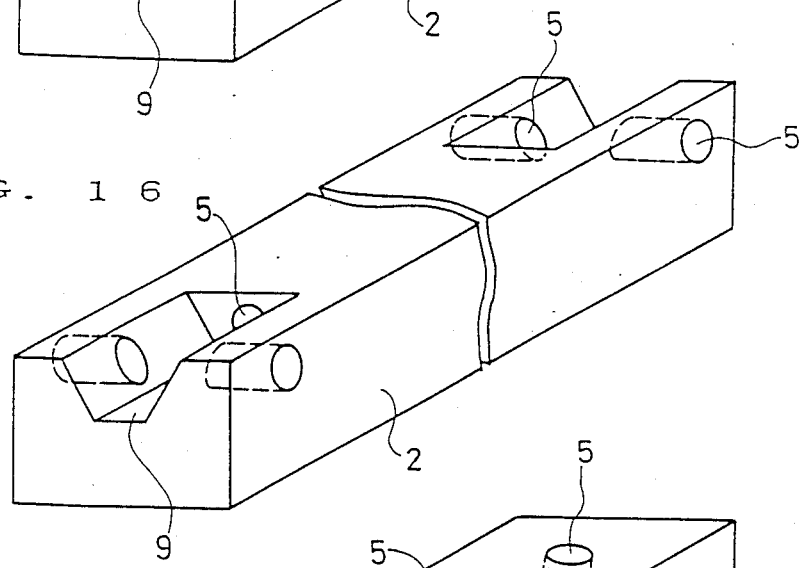
Figure 17:
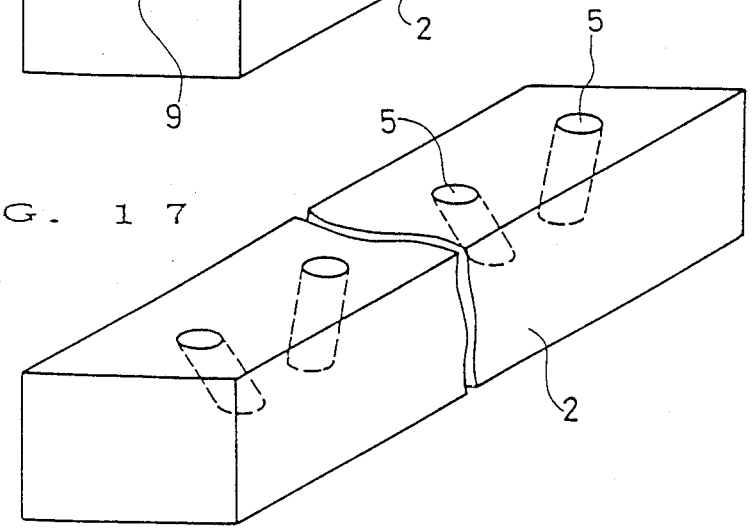
Figure 18:
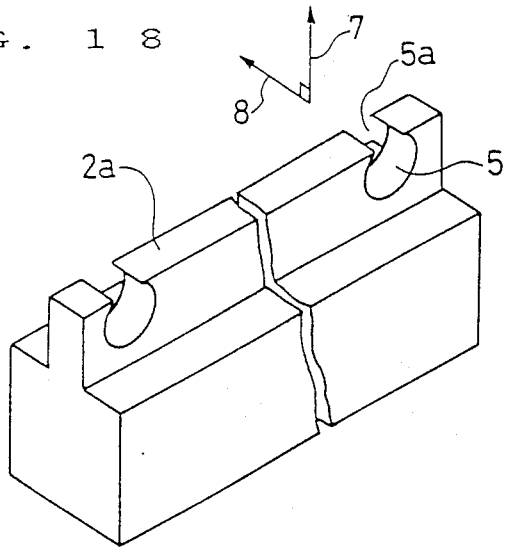
Figure 19:
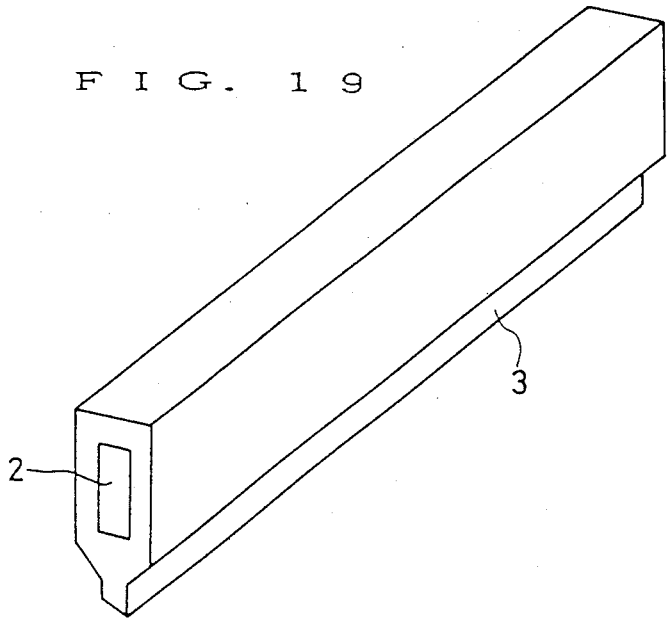
Figure 20:
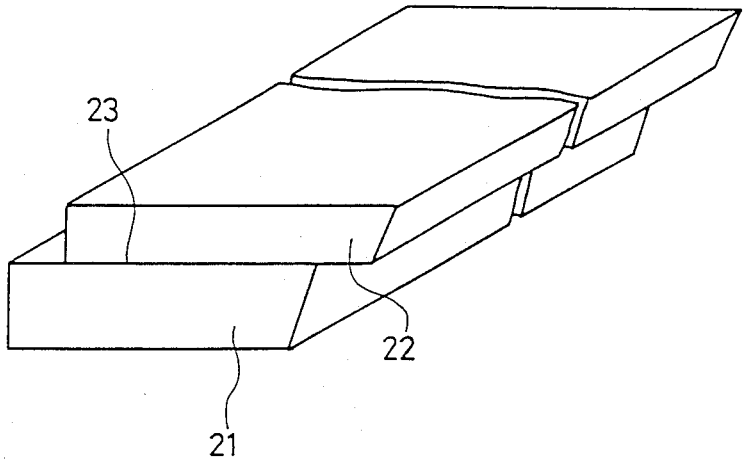

Separately, metallic holder 2 having projection 2a as shown in FIG. 1 was produced from stainless steel (SUS 304). The resin composition pellets above prepared were injection molded onto the metallic holder 2 by means of an injection molding machine ("Nissei 80T" molding machine) to obtain blade 1 of an electrophotographic apparatus having a structure in which the projection 2a of the metallic holder 2 was covered with the resin composition 3.

The resulting molded article was fitted to an electrophotographic apparatus for testing. The test was carried out by passing a toner through the interface between a developing roller and the molded article contacted with said roller under a load of 450 g, and the state of adhesion of the toner melted and solidified to the blade due to friction between the blade and the toner was observed, and the charge quantity of the electrified toner was measured.

With respect to dimensional precision of the molded article, the degree of influences of the straightness of the flat plane at the tip on formation of a thin layer of a toner was evaluated by passing a toner through the interface between the developing roller and the blade to spread the toner in a thin film, transferring the thin toner film onto an adhesive tape, and observing the unevenness of the toner density and occurrence of white streaks. The unevenness of the toner density and white streaks appear on reproduced images in the same state and are thus unfavorable. The results on the test are shown in Table 1.

TABLE 1

| | Comparative Example 1 | Example 1 | Example 2 | Comparative Example 2 | Remark |
|---|---|---|---|---|---|
| Composition: | | | | | |
| Total Amount of Fluorocarbon Polymer (wt %) | 97 | 90 | 65 | 55 | |
| Total Amount of Non-conductive Inorganic Filler (wt %) | 3 | 10 | 35 | 45 | Foaming was observed in the molded article of Comp. Ex. 2. |
| Adhesion of Toner | not observed | not observed | not observed | observed | Toner adhesion inhibits impartment of sufficient charge and formation of uniform thin toner layer. |
| Charging of Toner: | | | | | |
| In using Positively Chargeable toner (μC/g) | O +20 | O +15 | O +14 | X +3 | A good balance of charge quantity of toner between + and − is desirable. |
| In Using Negatively Chargeable Toner (μC/g) | X −2 | O −15 | O −13 | X −3 | Rating System: 0 to 3 μC/g: x 3 to 7 μC/g: Δ 7 to 20 μC/g: O more than 20 μC/g: Δ ~ x |
| Condition of Toner Thin Layer | Δ | O | O | X | O: uniform Δ: slight unevenness of density observed X: white streaks and unevenness of density observed |
| Overall Evaluation | X | O | O | X | |

EXAMPLES 3 TO 4 AND COMPARATIVE EXAMPLES 3 TO 4

A vinylidene fluoride-hexafluoropropylene copolymer ("Kynar 2800", produced by Pennwalt, Co.), positively chargeable zinc oxide having an average particle diameter of about 0.5 μm which had been dried so as to have a water content of 200 ppm or less, and, as a conductive filler, carbon black ("Ketjenblack EC") whose water content had been adjusted to 0.5% by weight or less were dry blended at a ratio shown in Table 2. The resulting dry blend was kneaded in a vented twin-screw extruder having a diameter of 30 mm at 245° C. to obtain pellets having an average particle diameter of about 3 mm.

The pellets were injection molded as an integral part of a metallic holder in the same manner as in Example 1 to obtain blade 1 of an electrophotographic apparatus. The resulting blade was evaluated in the same manner as in Example 1, and the results obtained are shown in Table 2.

TABLE 2

| | Comparative Example 3 | Example 3 | Example 4 | Comparative Example 4 |
|---|---|---|---|---|
| Composition: | | | | |
| (a) Amount of Fluorocarbon Polymer (wt %) | 100 | 80 | 80 | 80 |
| (b) Amount of Non-conductive Inorganic Filler (wt %) | — | 20 | 20 | 20 |
| (c) Amount of Conductive Filler (part by wt.) | — | 4 | 20 | 30 |
| Adhesion of Toner | not observed | not observed | not observed | observed |
| Charging of Toner: | | | | |
| In using Positively Chargeable Toner (μC/g) | Δ +22 | O +17 | O +17 | X +3 |
| In using Negatively Chargeable Toner (μC/g) | X −1 | O −17 | O −16 | X −3 |
| Condition of Toner Thin Layer | Δ | O | O | X |
| Overall Evaluation | X | O | O | X |

Note:
The amounts of the components (a) and (b) are based on (a) + (b).
The amount of the components (c) is based on 100 parts by weight of (a) + (b).

INDUSTRIAL APPLICABILITY

The blade of electrophotographic apparatus according to the present invention can be produced from a material exhibiting high dispersion qualities making use of mutual actions between the fluorocarbon polymer resin and the positively chargeable inorganic filler and, if used, the conductive filler through a simple and easy process while realizing high dimensional precision, taking the full advantage of the characteristics of thermoplasticity. The excellent dispersion qualities of the material endow the blade with stable charging characteristics and prevent toner from adhesion. Further, the material can be molded integrally with a metallic holder by a simple and easy molding method so that high function and high performance blades having high dimensional precision can be mass-produced in low cost for a merit of the process.

What is claimed is:

1. A blade of an electrophotographic apparatus using a toner, which is characterized in that the blade comprises a fluorocarbon polymer composition comprising 60 to 95% by weight of a fluorocarbon polymer, 40 to 5% by weight of a positively chargeable and non-conductive inorganic filler having an average particle diameter of 5 μm or less, and 0 to 25 parts by weight, per 100 parts by weight of the total of said fluorocarbon polymer and inorganic filler, of a conductive filler having an average particle diameter of 5 μm or less.

2. A blade as claimed, in claim 1, wherein said fluorocarbon polymer is a vinylidene fluoride-hexafluoropropylene copolymer, an ethylene-tetrafluoroethylene copolymer, or a tetrafluoroethylene-perfluoroalkylvinyl ether copolymer.

3. A blade as claimed in claim 1 or 2, wherein said positively chargeable and non-conductive inorganic filler is zinc oxide or magnesium oxide.

4. A blade as claimed in claim 1 or 2, wherein said conductive filler is a carbon-based filler.

5. A blade as claimed in claim 4, wherein said carbon-based filler is acetylene black or furnace black.

6. A blade as claimed in claim 5, wherein said furnace black is XCF (extra conductive furnace black), SCF (super conductive furnace black), CF (conductive furnace black), or SAF (super abrasion furnace black).

7. A blade as claimed in claim 1 or 2, wherein said blade is integrally molded with a metallic holder.

8. A blade as claimed in claim 7, wherein said blade is integrally molded with said metallic holder so as to cover a projection of said metallic holder whose tip is larger than the root thereof.

9. A blade as claimed in claim 7, wherein said blade is integrally molded with said metallic holder, with a part of said blade being filled in a recess of said metallic holder whose bottom is larger than the opening thereof.

10. A blade as claimed in claim 7, wherein said blade is integrally molded with said metallic holder, with a part of said blade being filled in perforations provided in said metallic holder to the direction different from the direction of release of the blade.

11. A blade as claimed in claim 7, wherein said blade is integrally molded with said metallic holder so as to include the metallic holder therein.

* * * * *